United States Patent [19]

Borum

[11] 3,938,433

[45] Feb. 17, 1976

[54] TRASH COMPACTOR WITH CLOCK TIMER CONTROL

[75] Inventor: Charles J. Borum, Troy, Ohio

[73] Assignee: Hobart Corporation, Troy, Ohio

[22] Filed: Sept. 17, 1974

[21] Appl. No.: 506,696

[52] U.S. Cl. ..... 100/51; 100/229 A

[51] Int. Cl.[2] ..... B30B 15/14

[58] Field of Search ..... 425/155, 156, 157; 100/43, 100/49, 51, 53, 48, 229 A; 307/141; 318/285; 74/3.5

[56] References Cited

UNITED STATES PATENTS

| | | | |
|---|---|---|---|
| 2,960,582 | 11/1960 | Harris | 74/3.5 |
| 3,714,890 | 2/1973 | Moon | 100/229 A |
| 3,869,978 | 3/1975 | Steinberg et al. | 100/53 |

FOREIGN PATENTS OR APPLICATIONS

| | | | |
|---|---|---|---|
| 1,162,790 | 8/1969 | United Kingdom | 74/3.5 |

*Primary Examiner*—Billy J. Wilhite

*Attorney, Agent, or Firm*—Biebel, French & Bugg

[57] ABSTRACT

A trash compactor is provided with manual controls for causing a compacting cycle and additional clock timer operated controls which can operate the compactor ram through a cycle with an extended delay period after a compacting stroke at some time of day when the compactor is unlikely to be in use for a substantial length of time.

3 Claims, 3 Drawing Figures

TRASH COMPACTOR WITH CLOCK TIMER CONTROL

BACKGROUND OF THE INVENTION

This application relates to trash compactors, particularly for domestic use, and to a control system which causes the compactor to exert compacting pressure on trash within its receptacle for an extended period of time, to maximize the degree of compaction obtained. One arrangement for accomplishing this function manually is disclosed in U.S. Pat. No. 3,722,404. Typical compactors to which the invention is applicable are disclosed in U.S. Pat. Nos. 3,734,009 and 3,756,144, both of which are assigned to the assignee of this application.

This application is related to copending U.S. application Ser. No. 506,695, filed concurrently herewith and assigned to the same assignee as this application.

SUMMARY OF THE INVENTION

A clock-timer unit is incorporated in the control circuits of a trash compactor. This unit is arranged to cause an operating cycle of the compactor with an extended dwell period after the compacting stroke of the ram. Such a cycle is started automatically at some pre-selected time of day when there is little use demand on the compactor, for example in the middle of the night. The cycle is completed by withdrawing the ram after the dwell period. The length of dwell can be selected by the clock-timer unit, or can be provided by delay circuitry having a predetermined delay time, or the retracting stroke of the cycle can be accomplished manually as when it is next desired to place some trash in the compactor receptacle.

The primary object of the invention is to provide such an automatic, extended dwell, compacting control in a trash compactor, particularly for domestic use, and to provide easily operated controls for that purpose.

Other objects and advantages of the invention will be apparent from the following description, the accompanying drawings and the appended claims.

DESCRIPTION OF THE PREFERRED EMBODIMENTS

Figure 1:
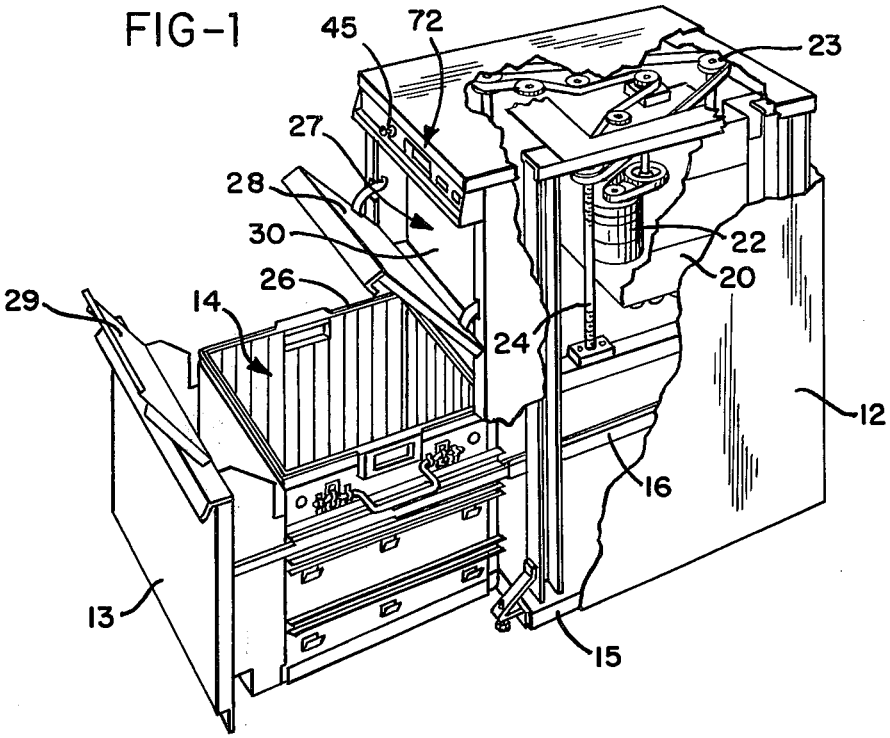
FIG. 1 is a perspective view of the compactor with part of the housing broken away, showing the receptacle thereof in a noncompacting position and the ram shown fully retracted.

As seen in FIG. 1 of the drawings, the compactor includes an upstanding housing 12 having a reciprocating door 13 behind which a receptacle 14 is located over the base 15. As shown in FIG. 1, the door and receptacle 14 may take the form of a drawer unit mounted on slides 16 for movement between a compacting position fully within the housing 12 and a noncompacting or loading position outwardly of the housing, as shown in dotted lines in FIG. 1. A ram 20 is also positioned in the housing and carries a motor 22 which, through a suitable drive chain such as shown in U.S. Pat. No. 3,734,009, drives sprockets 23 to cause the entire ram mounted assembly to move upwardly and downwardly along the stationary jack screws 24.

Thus, the ram is movable between a retracted position (as shown) wherein its lower surface clears an upper edge 26 of the receptacle, permitting the receptacle to be moved outwardly to a position where loading and unloading can occur, and a compacting position within said receptacle when the receptacle is fully positioned with the housing 12.

The drive motor 22 for the ram is provided with a starting and reversing control (FIG. 2) which will automatically initiate a cycle consisting of a compacting stroke of the ram, and a subsequent retracting stroke to the starting position. The compacting stroke ends after some predetemined load is imposed on the motor as it drives the ram in the compacting stroke. When the ram is away from its starting position the receptacle may be locked in the housing. Mechanism for this purpose is shown in U.S. Pat. No. 3,807,295 (Ser. No. 224,897, filed Feb. 9, 1972).

While the receptacle 14 is locked in position during initial compacting movement of the ram, access may still be had to a storage compartment 27 of the compactor through the upper access door 28. Waste material, particularly small items such as milk cartons, bottles, cans, etc., can be deposited in the compactor, where they will rest in a small compartment formed by the inclined shelf 29 on the drawer unit and the protective wall 30 in the housing 12, until such time as the receptacle 14 is moved outwardly of the housing. The shelf 29 also serves as the top of a bag storage compartment behind the door 13, and is shown in the open position. When the drawer unit is within the housing, the shelf 29 is pivoted downwardly and leads into the receptacle 14 by slightly overhanging the upper edge 26 of the receptacle. For more details, refer to U.S. Pat. No. 3,756,144. As the receptacle 14 is moved toward the position shown in FIG. 1, articles lying on shelf 29 will fall into the receptacle. The user, therefore, need not wait until the receptacle is unlocked, or until the ram is fully retracted, to deposit material in the compactor, but he is of course protected against injury, etc., by wall 28 during operation of the ram, since the compartment 27 is totally independent of the receptacle 14 when the drawer unit is within the housing 12.

A normally open safety interlock switch 35 is mounted inside the front of the housing and is closed by a pin (not shown) on the door when the receptacle 14 is in its compacting position.

A further interlock is provided by the normally closed switch 40 which is wired in parallel with switch 35. Switch 40 is operated by an arm (not shown) carried by ram 20, and arranged such that the switch is opened until the ram lower surface is just below or within the upper edge 26 of the receptacle, for example, within about one inch of the edge 26. In other words, switch 40 is closed only when the ram has entered the receptacle and thus acts to prevent the drawer unit from being opened, intentionally or accidentally.

Figure 2:
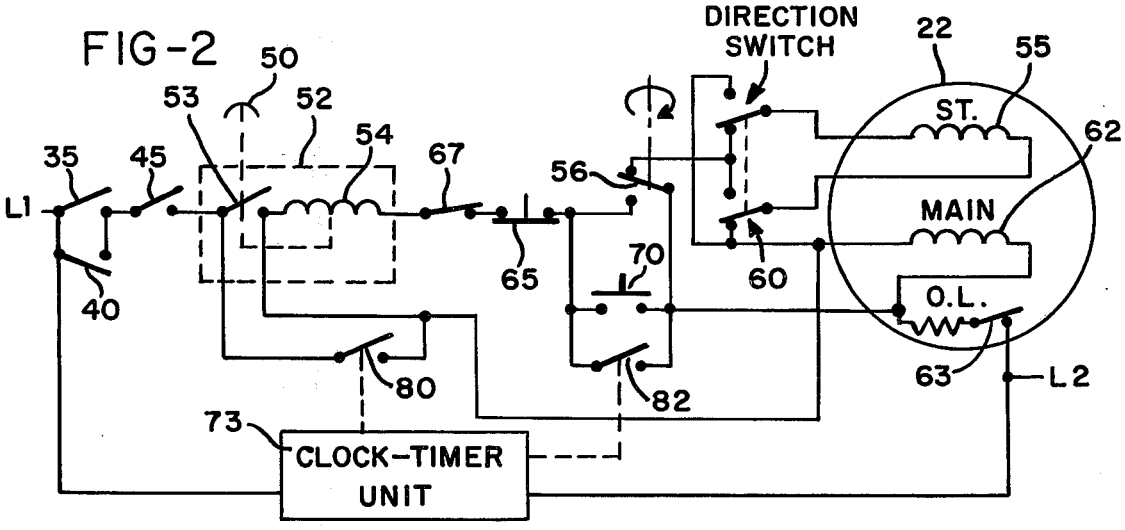
FIG. 2 is a representation of a control circuit for an embodiment of the present invention.
Figure 3:
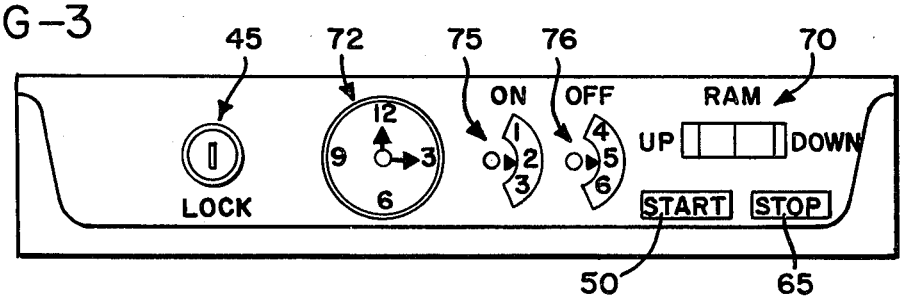
FIG. 3 shows the control panel for the compactor.

Referring to FIGS. 2 and 3, one embodiment of the control system is shown. Interlock switch 35 is closed only when the drawer is closed, and it controls all power to the unit together with key switch 45. Contacts are shown in the position with the drawer open, the ram up, motor stopped, and the key safety switch open. With the key switch 45 operated to close, and the drawer closed, pushing the start button 50 on relay 52 will close its contact 53 and apply power to the starting winding 55 of ram motor 22, through the motor's centrifugal starting switch 56, and through the contacts of a directional switch 60. A power circuit is also completed to main winding 62. The overload protector 63 is included in these circuits as protection for the motor.

The holding circuit for relay 52 includes its coil 54, manual stop switch 65 which is normally closed, a normally closed ram-operated switch 67, and the normally open (when stopped) contacts of centrifugal switch 56. Switch 67 is arranged to be opened momentarily by the ram only when it is nearing the top of its return stroke. This can be accomplished as disclosed in the related application Ser. No. 279,985, now U.S. Pat. No. 3,808,453. On the compacting stroke switch 67 is unaffected and remains closed, but on the upward retracting stroke the switch is momentarily opened just as the ram approaches its fully retracted position. Directional switch 60 is carried by the ram and is held in the position shown only when the ram is fully up. When the ram is in any other position, the blades of switch 60 transfer to the contacts shown open.

Thus, as power is first applied the motor 22 starts in a direction to lower the ram in a compacting stroke. The motor immediately comes up to speed, since it is under only a slight load, and switch 56 transfers to seal in relay 52. However, transferring of the contacts of switch 60 has no effect on motor direction. This change in the direction switch prepares the circuit for reversing the motor as soon as the compaction stroke is resisted enough to slow the motor to a speed where switch 56 closes.

As explained in the related application Ser. No. 506,695, a manually operable selector switch 70 is connected across the normally open contacts of centrifugal switch 56. In its closed position, switch 70 bypasses these normally open contacts and the motor immediately reverses, withdrawing the ram. Near the end of the retracting ram movement switch 67 momentarily opens, deenergizing coil 54 of the starting relay and opening switch 53. The motor coasts to a stop past the actuation position of switch 67, so that it again closes. Switch 60 is moved to the position shown, such that the circuit is ready for the next compacting stroke, just before switch 67 is actuated. In this mode of switch 70 the delay at the end of the compacting stroke is eliminated. After a compacting stroke begins switch 40 closes, bypassing interlock switch 35 since the ram is now inside the receptacle. Thereafter, if stop switch 65, or key switch 45, is opened, or the motor overload protector 63 opens, the circuit energizing relay 52 will be broken, and the motor will stop.

If selector switch 70 is opened, when the ram halts at the end of its compacting stroke, the power supply circuit to the motor will be opened since centrifugal switch 56 has transferred to its normally closed contact, and this breaks the holding circuit for relay 52. The ram maintains pressure on the trash in the container until the selector switch is closed and the start button 50 is again actuated. Then the holding circuit will be re-established and the motor will start in a direction to raise the ram, as previously explained. Thus the selector switch 70 can be said to have up (closed) or down (open) positions which correspond to where the ram is stopped after it begins a compacting operation.

In order to obtain the benefit of an extended period of pressure compaction of the trash, the present invention provides a clock-timer control which can produce a compactor cycle with an extended dwell period at the end of the compacting stroke. FIG. 3 shows the control panel of the compactor, with the various manually operable switches indicated by the same reference numerals as used in the FIG. 2 diagram. In addition, there is a clock 72 which is part of a conventional on-off timer clock mechanism 73 shown in block form in FIG. 2. As is well known, such clock-timer units include a manually set control 75 for selecting a time when the clock-timer turns a control unit on, and a further manually set control 76 which selects a later time at which the clock-timer unit shuts off the unit. Power to the clock-timer unit 73 is applied by connecting it between the supply lines L1–L2, and one control switch 80 of the clock-timer unit is connected in parallel with the push-button operated start switch 53, and another control switch 82 is connected in parallel with the up-down selector switch 70.

In operation, the on-time selector 75 may be set for some time of day when it is unlikely that the compactor will be used, and the off-time selector 76 can be set for a somewhat later time. When the clock 72 reaches the selected on-time, it momentarily closes switch 80 of the clock-timer unit and this starts the compacting cycle in the same manner as if the button 50 were pushed to close start switch 53. The ram then proceeds on its compacting cycle and stops, it being assumed that the switch 70 has been placed in the open or "down" position. When the clock reaches the time selected by the off-time selector 76, this causes both control switches 80 and 82 to close momentarily, starting the ram on its retracting stroke and completing the cycle. Obviously, the operator can select the length of the dwell period for whatever is desired, and he can cause this extended cycle to occur in the middle of the night, or at some other time when it is unlikely the compactor will be needed for loading or unloading. It should also be noted that at all times the compartment 27 is available to receive small items of trash, since these can be loaded into the storage compartment even when the ram is operating or in its compacting position.

In addition, it is possible to utilize a somewhat simpler clock-timer unit which only initiates the beginning of the extended cycle, and the time of the delay period can be derived from other time delay controls, as explained for example in said copending application Ser. No. 506,695 , or the delay period can be terminated by causing the ram to be retracted manually, as by moving switch 70 to its "up" position. It is also possible to provide for several extended dwell compacting cycles at predetermined times of the day, for example by utilizing a clock-timer unit which actuates the control switch 80 at a number of different preselected times, and either by providing for additional joint operations of the control switches 80, 82 by the clock-timer unit, or by utilizing other delay devices as previously mentioned to determine the length of the ram dwell time.

While the form of apparatus herein described constitutes a preferred embodiment of the invention, it is to be understood that the invention is not limited to this precise form of apparatus, and that changes may be made therein without departing from the scope of the invention.

What is claimed is:

1. A control for a compacting machine having a receptacle for trash material and a ram mounted for compacting movement in a compacting stroke entering said receptacle and an opposite retracting stroke to a retracted starting position, a power supply, a reversible motor connected to drive said ram, a manually initiated cycle control circuit for said motor including a directional switch connected to cause forward and reverse operation of said motor in a cycle corresponding to the compacting and retracting strokes of said ram and a starting switch for operatively connecting said directional switch with said power supply;

the improvement comprising a timer unit having control means connected in said circuit to start said motor and to operate said ram independent of manual initiation through a compacting stroke at a predetermined time, to stop said ram upon completion of the compacting stroke, and to delay the retracting stroke of said ram for a substantial period of time.

2. A control for a compacting machine having a receptacle for material to be compacted and a power operated ram mounted for cyclical movement in a compacting stroke entering said receptacle and an opposite retracting stroke to a starting position removed from said receptacle, a reversible drive connected to said ram, a directional switch connected to control forward and reverse operation of said drive corresponding to the compacting and retracting strokes of said ram, and a control circuit incorporating said directional switch and operative to power said drive to move said ram to compact material in the receptacle and then to retract the ram and stop;

the improvement comprising clock-controlled means incorporated in said circuit and operative to cause an automatic cycle of ram movement independent of manual initiation through compacting and retracting strokes and a delay period at the end of a compacting stroke of sufficient length to cause the compacted material to remain in the deformed compacted condition.

3. A control for a compacting machine having a receptacle for trash material and a ram mounted for compacting movement in a compacting stroke entering said receptacle and an opposite retracting stroke to a retracted starting position, a power supply, a reversible motor connected to drive said ram, a manually initiated cycle control circuit for said motor including a directional switch connected to cause forward and reverse operation of said motor in a cycle corresponding the compacting and retracting strokes of said ram and a starting switch for operatively connecting said directional switch with said power supply;

the improvement comprising a timer unit connected to actuate said control circuit automatically at a preselected time independent of manual initiation to initiate a cycle and to stop said ram upon completion of a compacting stroke for a substantial period of time, and means operative to complete the automatically actuated cycle by retracting said ram at the end of said time period.

* * * * *